US006525469B1

(12) United States Patent
Huang et al.

(10) Patent No.: US 6,525,469 B1
(45) Date of Patent: Feb. 25, 2003

(54) FULL-COLOR PLASMA DISPLAY PANEL WITH RIBS EXTENDING ALONG TWO DIRECTIONS

(75) Inventors: Jih-Fon Huang, Chu-Pei (TW); Yu-Ting Chien, Yung-Ho (TW)

(73) Assignee: Au Optronics Corp., Hsinchu (TW)

( * ) Notice: Subject to any disclaimer, the term of this patent is extended or adjusted under 35 U.S.C. 154(b) by 308 days.

(21) Appl. No.: 09/606,048

(22) Filed: Jun. 29, 2000

(30) Foreign Application Priority Data

Mar. 10, 2000 (TW) ..... 89104331 A

(51) Int. Cl.[7] ..... H01J 17/49; H01J 63/04
(52) U.S. Cl. ..... 313/582; 313/485
(58) Field of Search ..... 313/582–587, 313/495–497, 484–486

(56) References Cited

U.S. PATENT DOCUMENTS 5,763,139 A * 6/1998 Matsunaga et al. ..... 313/485
5,896,001 A * 4/1999 Shishido ..... 242/348
6,348,762 B1 * 2/2002 Nunomura et al. ..... 313/582

FOREIGN PATENT DOCUMENTS

JP 11185631 A * 7/1999

* cited by examiner

*Primary Examiner*—Nimeshkumar D. Patel
*Assistant Examiner*—German Colón
(74) *Attorney, Agent, or Firm*—Winston Hsu

(57) ABSTRACT

A plasma display panel (PDP) has a front and a back substrate mounted together, with a gap between them. Barrier ribs are positioned within this space of this gap, and they define a series of discharge space groups. Each discharge space group has a first, second and third discharge space for red, green and blue emitting phosphors. Within these discharge spaces are traverse ribs. The lengths of these traverse ribs are adjusted to change the relative proportions of phosphor surface areas, and thus adjust the color temperature of the PDP.

5 Claims, 4 Drawing Sheets

FULL-COLOR PLASMA DISPLAY PANEL WITH RIBS EXTENDING ALONG TWO DIRECTIONS

BACKGROUND OF THE INVENTION

1. Field of the invention

The present invention relates to a full-color plasma display panel, and more particularly, to a full-color plasma display panel with a high color temperature that is achieved by adjusting the coverage of the phosphor materials within the plasma display panel.

2. Description of the Prior Art

A full-color plasma display panel (PDP) is composed of hundreds of thousands of tiny discharge cells arranged in a matrix formation. When a voltage is induced in one of these discharge cells, it causes a gas in the cell to discharge and generate ultra-violet radiation. This ultra-violet radiation falls on different phosphor materials and causes them respectively to emit one of three primary colors of light, i.e., red, green, or blue. Generally, the color of the emitted light depends on the composition of the phosphor materials. If the phosphor material is made of $(Y,Gd)BO_3$, and Eu is added as a luminescent agent, the phosphor material will emit red light. If the phosphor material is made of $Zn_2SO_4$, and Mn is added as a luminescent agent, the phosphor material will emit green light. If the phosphor material is made of $BaMgAl_{14}O_{23}$, and Eu is added as a luminescent agent, the phosphor material will emit blue light. However, this blue light suffers from color degradation at higher temperatures. In order to improve the luminescence of the PDP, the discharge space for blue light is enlarged to increase the coverage of the associated phosphor materials. In this manner, the proportion of emitted red light, green light, and blue light of the PDP can be adjusted so as to promote color temperatures in the range of 7000K to 11000K.

Please refer to FIG. 1. FIG. 1 is a schematic diagram of a full-color plasma display panel 10 according to the prior art. The prior art PDP 10 comprises a first substrate 12, a second substrate 14 positioned in parallel to the first substrate 12, a discharge gas filling the space between the first substrate 12 and the second substrate 14, and a plurality of first electrodes 18, second electrodes 20, and address electrodes 22. Each of the first electrodes 18 and the second electrodes 20 are. alternately positioned on the first substrate 12 in parallel to each other. Each of the address electrodes 22 is positioned on the second substrate 14 perpendicular to the first electrodes 18 and the second electrodes 20. Each of the first electrodes 18 and the second electrodes 20 comprises a support electrode 181, 201 made of ITO, and a complementary electrode 182, 202 made of Cr/Cu/Cr, a sandwiched structure with three metallic layers. The support electrode 181, 201 is transparent to most visible light, but has great electrical resistance. The complementary electrode 182, 202 has better conductivity and thus enhances the conductivity of the first electrodes 18 and the second electrodes 20.

The PDP 10 further comprises a dielectric layer 24 that covers the first substrate 12, a protective layer 26 covering the dielectric layer 24, a plurality of barrier ribs 28 positioned on the second substrate 14 in parallel to each other for isolating two adjacent address electrodes 22 and defining a plurality of line-shaped discharge spaces 30, and a phosphor layer 32 coating the surfaces of the second substrate 14 and the walls of the barrier ribs 28 that surround each discharge space. The phosphor layer 32 emits red light, green light or blue light. Each of the discharge spaces 30 comprises a plurality of unit display elements 34 arranged in matrix formation between the first substrate 12 and the second substrate 14. All of the discharge spaces 30 are divided into a plurality of discharge space groups. Each of the groups comprises a red discharge space 30R coated with a red phosphor layer 32R, a green discharge space 30G coated with a green phosphor layer 32G, and a blue discharge space 30B coated with a blue phosphor layer 32B. Consequently, a plurality of red unit display elements 34R are formed within the red discharge spaces 30R, a plurality of green unit display elements 34G are formed within the green discharge spaces 30G, and a plurality of blue unit display elements 34B are formed within the blue discharge spaces 30B. Generally, one red unit display element 34R, one green unit display element 34G, and one blue unit display element 34B form a pixel.

In order to improve the luminescence of blue light emitted from the PDP 10, the width of the red discharge space 30R is designed to be the narrowest. The width of the green discharge space 30G is designed to be 1.2 times as wide as the width of the red discharge space 30R. The width of the blue discharge space 30B is designed to be 1.6 times as wide as the width of the red discharge space 30R. Therefore, the red unit display element 34R has smallest space, and the blue unit display element 34B has the largest space. Hence, the coverage of the red phosphor layer 32R is the smallest, and the blue phosphor layer 32B has the largest coverage. Under these size ratios, the red, green and blue light will combine to form white light with a color temperature of about 11000K.

However, the widths of the different discharge spaces 30 are designed according to specific proportions. When the size of all of the discharge spaces 30 needs to be reduced to increase the resolution of the PDP 10, the width of the red discharge space 30R can become quite small. This not only increases the difficulty of manufacturing the barrier ribs 28 and the red phosphor layer 32R, but can also lead to contraposition when sealing the first substrate 12 to the second substrate 14. Furthermore, the red discharge space 30R with a much smaller width can easily cause the discharge gas to cross talk with the adjacent discharge spaces 30. This interference damages the electrical performance of the PDP 10.

SUMMARY OF THE INVENTION

It is therefore a primary objective of the present invention to provide a full-color PDP with a higher color temperature by adjusting the coverage of the phosphor layer, and thus avoid the above-mentioned problems of the prior art.

In a preferred embodiment, the present invention provides a plasma display panel that comprises a back substrate, a front substrate positioned on the back substrate, with a space between the facing surfaces of the front substrate and the back substrate. A plurality of barrier ribs are positioned in the space for defining a plurality of discharge space groups wherein each group comprises a first discharge space and a second discharge space. A first traverse rib is positioned in each first discharge space. A second traverse rib is positioned in each second discharge space wherein the transverse length of the second traverse rib is smaller than that of the first traverse rib. A first phosphor layer is coated on the surfaces of the back substrate, the first traverse ribs, and on the barrier ribs surrounding each first discharge space. A second phosphor layer is coated on the surfaces of the back substrate, the second traverse ribs, and on the barrier ribs surrounding each second discharge space. The coverage of the first phosphor layer is greater than that of the second phosphor layer. For a first discharge space and a second discharge space, a distance between the side of the first traverse rib and the center of the first discharge space is less than a distance between the side of the second traverse rib and the center of the second discharge space. Thus, the luminous intensity of the first phosphor layer is greater than that of the second phosphor layer.

It is an advantage of the present invention that the plurality of barrier ribs, cooperating with the traverse ribs of various size and placements, adjusts the coverage of the phosphor layers. This adjusts the coverage proportions of the phosphor layers coated within each discharge space to promote a color temperature of the PDP of up to 11000K.

These and other objectives of the present. invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

The First Embodiment

Figure 1:
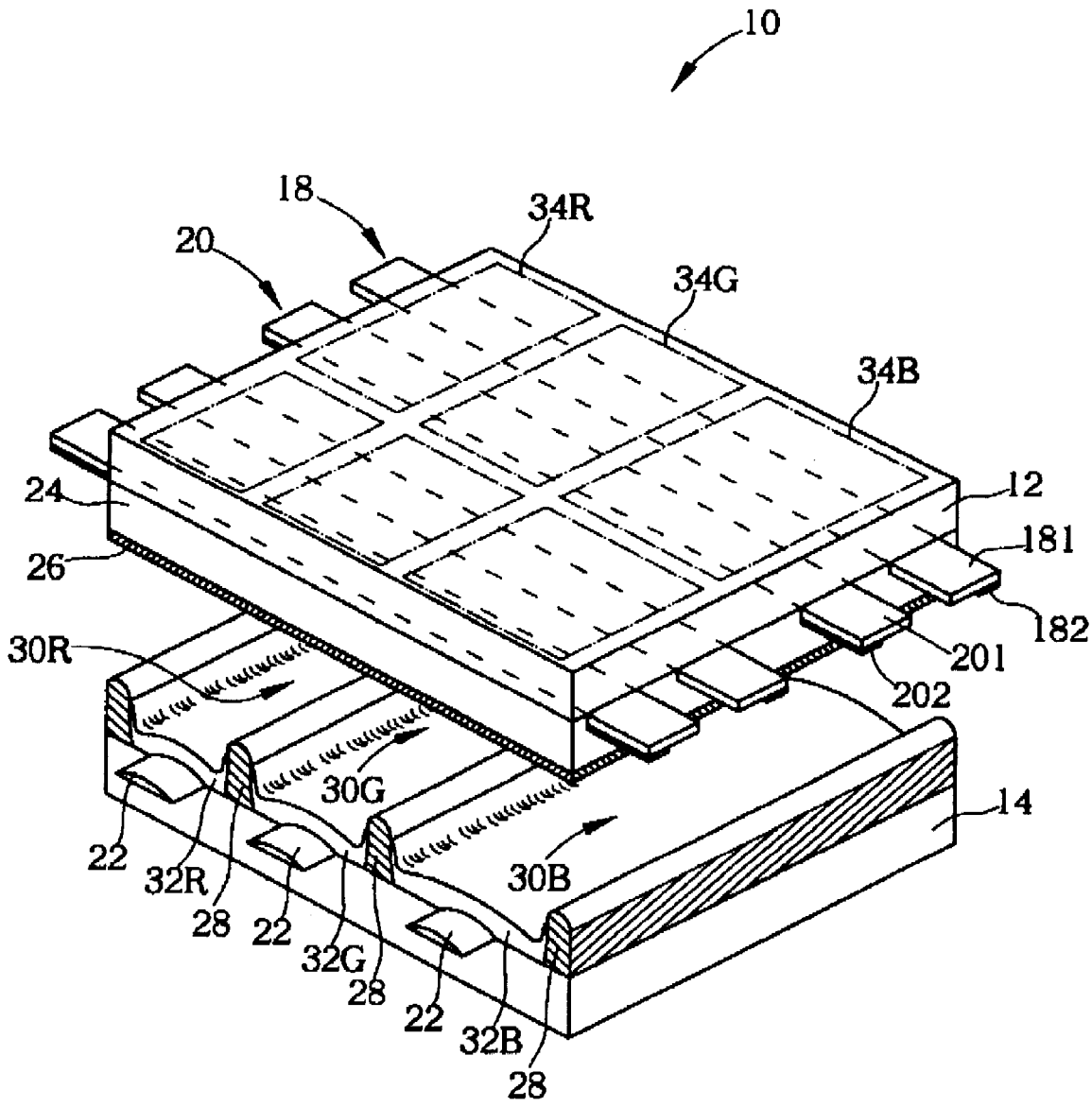
Fig. 1 Prior art
FIG. 1 is a schematic diagram of a full-color plasma display panel according to the prior art.
Figure 2:
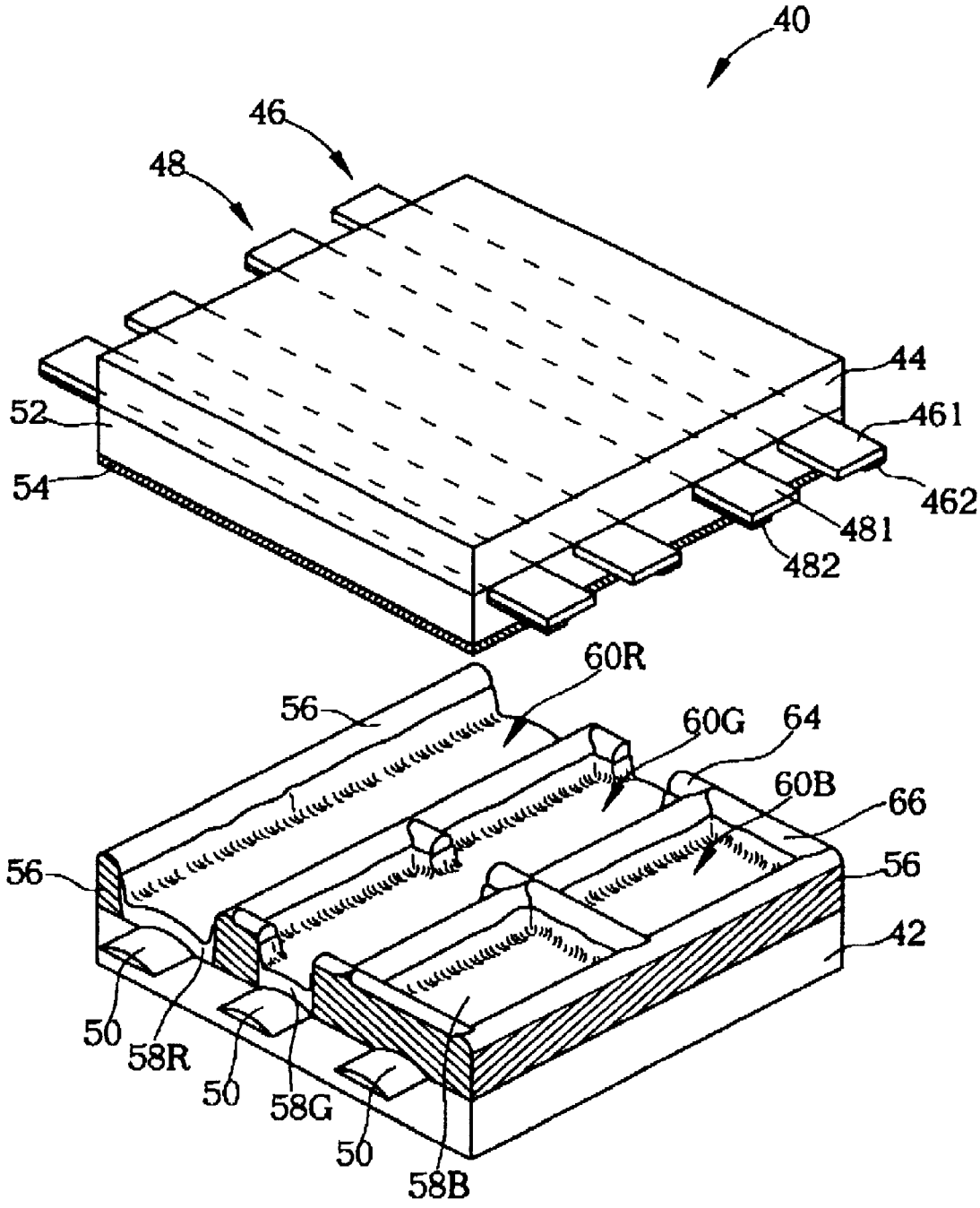
FIG. 2 is a schematic diagram of a full-color PDP according to the first embodiment of the present invention.
Figure 3:
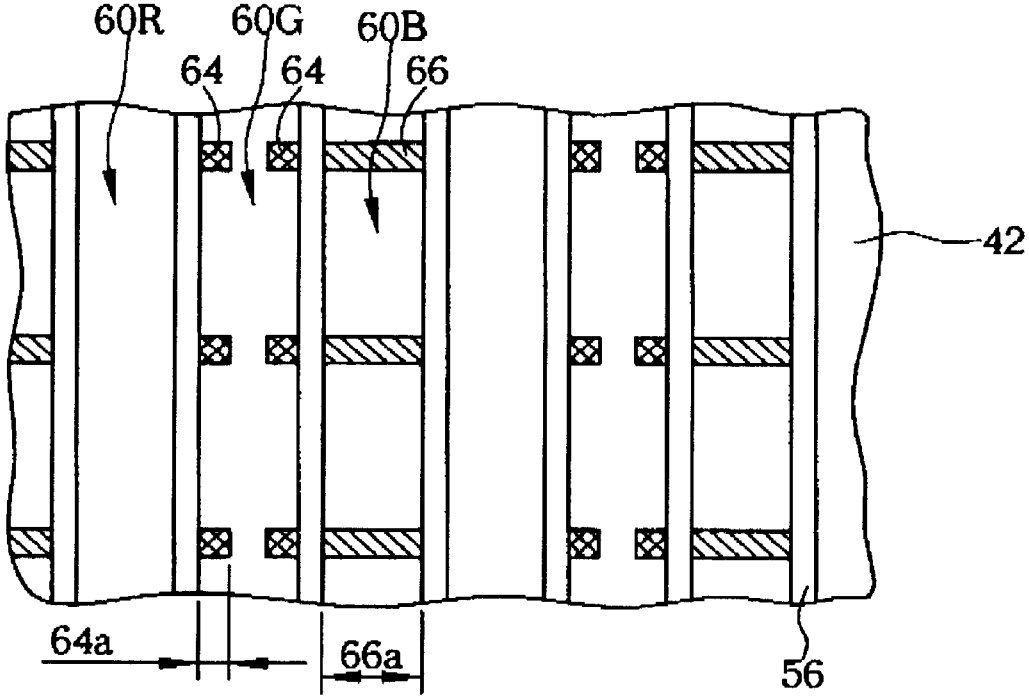
FIG. 3 is a top view of the plurality of barrier ribs shown in FIG. 2.

Please refer to FIG. 2 and FIG. 3. FIG. 2 is a schematic diagram of a full-color PDP 40 according to the first embodiment of the present invention. FIG. 3 is a top view of the plurality of barrier ribs shown in FIG. 2. According to the first embodiment of the present invention, a full-color PDP 40 comprises a back substrate 42, a front substrate 44 positioned on and in parallel with the back substrate 42, a discharge gas (not shown) that fills the space between the back substrate 42 and the front substrate 44, a plurality of first electrodes 46, second electrodes 48 and address electrodes 50, a dielectric layer 52 that covers the front substrate 44, and a protective layer 54 covering the dielectric layer 52. Each of the first electrodes 46 and the second electrodes 48 are positioned in an alternating manner on the front substrate 44, and are parallel to each other. Each of the address electrodes 50 is positioned on the back substrate 42 and is perpendicular to the first electrodes 46 and the second electrodes 48. Each of the first electrodes 46 and second electrodes 48 comprises a wider line-width support electrode 461, 481, and a narrower line-width complementary electrode 462, 482. The support electrode 461, 481 is made of indium tin oxide (ITO) or tin oxide (SnO) for maintaining surface discharge. Transparent, the support electrode 461, 481 has a high electrical resistance. The complementary electrode 462, 482 is from a Cr/Cu/Cr sandwich of three metallic layers, or a Ag metal material. The complementary electrode 462, 482 increases the conductivity of the first electrode 46 and the second electrode 48.

The full-color PDP 40 further comprises a plurality of barrier ribs 56 equidistantly positioned on the back substrate 42 and in parallel with each other. The barrier ribs 56 define a plurality of discharge space groups. The full-color PDP 40 also has a plurality of first traverse ribs 66, a plurality of second traverse ribs 64, and a plurality of phosphor layers coated within the discharge space groups. Each of the discharge space groups comprises a red discharge space 60R, a green discharge space 60G, and a blue discharge space 60B. In the blue discharge. space 60B, two of the first traverse ribs 66 are positioned on the walls of the barrier ribs 56 and each first traverse rib 66 is connected with two adjacent barrier ribs 56. In the green discharge space 60G, the four second traverse ribs 64 are not connected to each other, and each is positioned on the walls of the barrier ribs 56. The plurality of phosphor layers comprises a red-emissive phosphor layer 58R, a green-emissive phosphor layer 58G, and a blue-emissive phosphor layer 58B. The blue-emissive phosphor layer 58B is coated on the surfaces of the back substrate 42, the first traverse ribs 66 and the barrier ribs 56 that surround each blue discharge space 60B. The green-emissive phosphor layer 58G is coated on the surfaces of the back substrate 42, the second traverse ribs 64 and the barrier ribs 56 that surround each green discharge space 60G. The red-emissive phosphor layer 58R is coated on the surfaces of the back substrate 42 and the barrier ribs 56 surrounding each red discharge space 60R.

As shown in FIG. 3, the longitudinal length of the second traverse rib 64 is equal to that of the first-traverse rib 66. The transverse length 64*a* of the second traverse rib 64 is smaller than that 66*a* of the first traverse rib 66. Thus, the surface area of the barrier ribs 56 and the first traverse ribs 66 surrounding the blue discharge space 60B is the greatest in size. The surface area of the barrier ribs 56 and the second traverse ribs 64 surrounding the green discharge space 60G is the next greatest. The surface area of the barrier ribs 56 surrounding the red discharge space 60R has the smallest size. In other words, the blue-emissive phosphor layer 58B within the blue discharge space 60B has the greatest coverage, while the red-emissive phosphor layer 58R within the red discharge space 60R has the smallest coverage. For the blue discharge space 60B and the green discharge space 60G, a distance between the side of the first traverse rib 66 and the center of the blue discharge space 60B is less than a distance between the side of the second traverse rib 64 and the center of the green discharge space 60G. Consequently, the luminous intensity of the blue-emissive phosphor layer 58B is greater than that of the green-emissive phosphor layer 58G. For the red discharge space 60R without any traverse ribs, the luminous intensity of the red-emissive phosphor layer 58R is the smallest. The proportion of emitted blue light is thus increased. Red, green and blue light will mix to form white light with a color temperature of about 11000K.

If all of the width of all of the discharge spaces needs to be reduced, the barrier ribs 56 remain equidistantly spaced, while the first traverse ribs 66 and second traverse ribs 64 can be adjusted to alter the coverage proportions of the phosphor layers. Therefore, it is unnecessary to over-reduce the space between two adjacent barrier ribs 56. This helps to lower the manufacturing difficulty of the PDP40, and avoids degradation of the electrical performance caused by cross talking of the discharge gas.

The Second Embodiment

Figure 4:
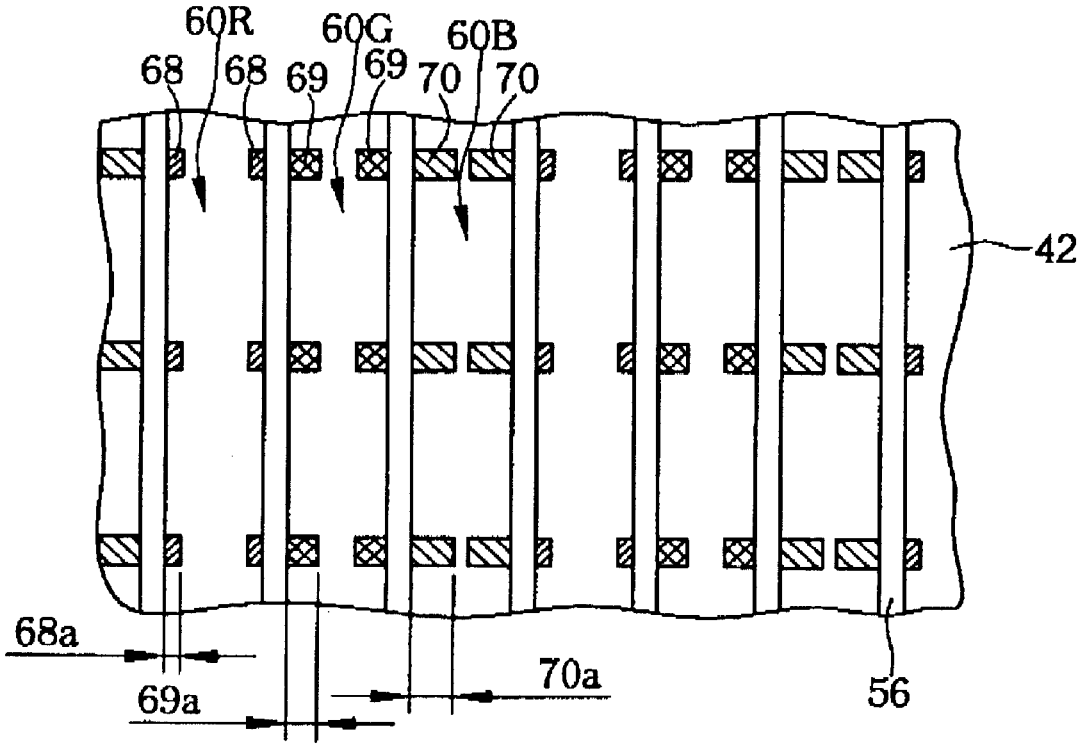
FIG. 4 is a top view of a plurality of barrier ribs according to the second embodiment of the present invention.

The coverage of the phosphor layers coated within the discharge spaces can be changed by the placement of traverse ribs with different sizes, shapes and positions. Please refer to FIG. 4. FIG. 4 is a top. view of the plurality of barrier ribs 56 according to the second embodiment of the present invention. The full-color PDP comprises a plurality of barrier ribs 56 equidistantly positioned on the back substrate 42. As before, the barrier. ribs 56 are all parallel to each other. Each of the discharge spaces comprises. a plurality of traverse ribs that are unconnected to each. This ensures that the discharge spaces are not completely closed after sealing the front substrate 44 to the back substrate 42. Such a design is beneficial for a subsequent process that involves the extraction of gases from the discharge spaces. A plurality of first traverse ribs 70, unconnected to each other, are positioned on the walls of two adjacent barrier ribs 56 surrounding each blue discharge space 60B. A plurality of second traverse ribs 69, also unconnected to each other, are positioned on the walls of two adjacent barrier ribs 56 surrounding each green discharge space 60G. Similarly, a plurality of third traverse ribs 68, unconnected to each other, are positioned on the walls of two adjacent barrier ribs 56 surrounding each red discharge space 60R.

The longitudinal length of the first traverse ribs 70 is equal to that of the second traverse ribs 69 and to that of the third traverse rib 68. The first traverse ribs 70 have the greatest transverse length 70*a*. The second traverse ribs 69 have the next greatest transverse length 69*a*. Finally, the third traverse ribs 68 have the shortest transverse length 68*a*. Thus, the barrier ribs 56 and the first traverse ribs 70 within the blue discharge space 60B have the greatest surface area. The barrier ribs 56 and the third traverse ribs 68 within the red discharge space 60R have the least surface area. Hence, the blue-emissive phosphor layer 58B within the blue discharge space 60B has the greatest coverage, whereas the red-emissive phosphor layer 58R within the red discharge space 60R has the smallest coverage. Note that the distance between the side of the first traverse rib 70 and the center of the blue discharge space 60B is shorter than an equivalent distance in either the red or green discharge spaces. The green discharge space 60G has the next shortest such distance. Generally, those portions of a phosphor layer close to the center of the discharge space where the plasma intensity is the highest receive more ultra-violet radiation. Consequently, the luminous intensity of the blue-emissive phosphor layer 58B is the greatest, the luminous intensity of the green-emissive phosphor layer 58G is second, and the red-emissive phosphor layer 58R is the smallest luminous intensity. This increases the proportion of blue light, which boosts the color temperature of the PDP 40 up to about 11000K.

The Third Embodiment

Figure 5:
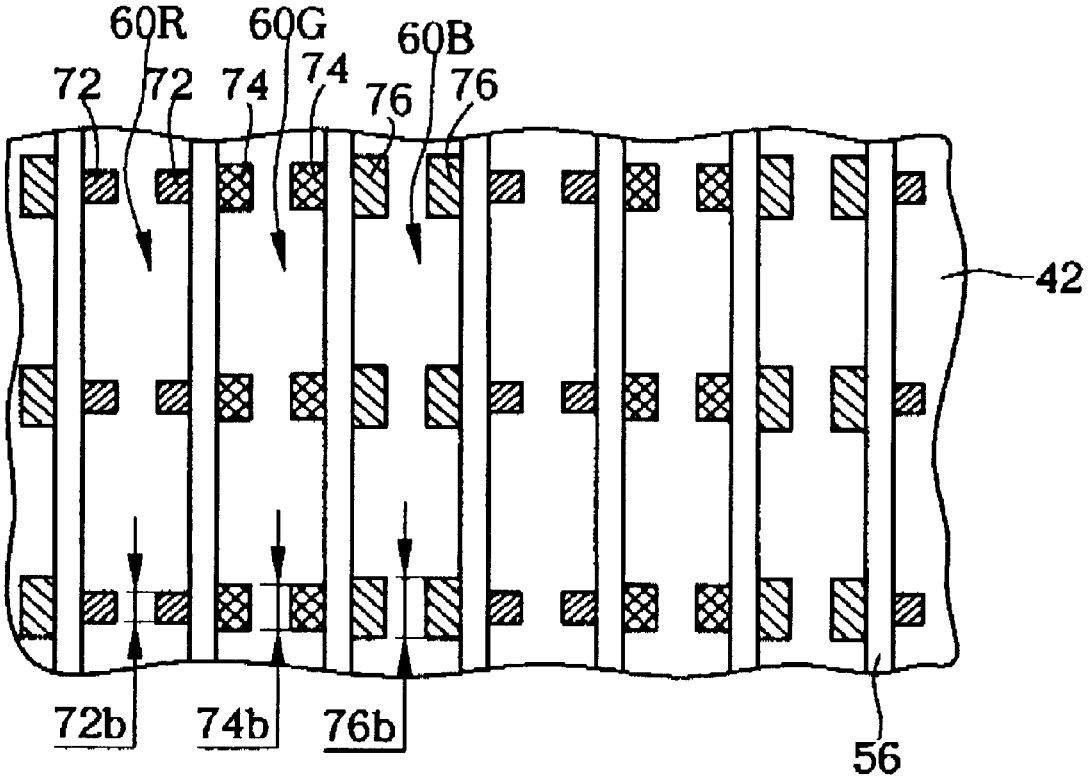
FIG. 5 is a top view of a plurality of barrier ribs according to the third embodiment of the present invention.

Please refer to FIG. 5. FIG. 5 is a top view of the plurality of barrier ribs 56 according to the third embodiment of the present invention. The full-color PDP comprises a plurality of barrier ribs 56 equidistantly positioned on the back substrate 42. The barrier ribs 56 are in parallel with each other. A plurality of first traverse ribs 76, unconnected to each other, are positioned on the walls of two adjacent barrier ribs 56 that surround each blue discharge space 60B. A plurality of second traverse ribs 74, unconnected to each other, are positioned on the walls of two adjacent barrier ribs 56 surrounding each green discharge space 60G. A plurality of third traverse ribs 72, unconnected to each other, are positioned on the walls of two adjacent barrier ribs 56 surrounding each red discharge space 60R. The transverse length of the first traverse rib 76 is equal to that of the second traverse rib 74 and to that of the third traverse rib 72. The longitudinal length 76*a* of the first traverse rib 76 is the greatest (about 320 $\mu$m), the longitudinal length 74*b* of the second traverse rib 74 is second (about 160 $\mu$m), and the longitudinal length 72*b* of the third traverse rib 72 is the smallest (about 80 $\mu$m). Consequently, the blue-emissive phosphor layer 58B coated on the first traverse rib 76 is closest to the center of the blue discharge space 60B, and thus receives the highest intensity of ultra-violet radiation. The red-emissive phosphor layer 58R coated on the third traverse rib 72 is farthest from the center of the red discharge space 60R, and thus receives the lowest intensity of ultra-violet radiation. Hence, the luminous intensity of the blue-emissive phosphor layer 58B is the greatest., and the red-emissive phosphor layer 58R has the weakest luminous intensity. This increases the proportion of blue light to boost the color temperature of the PDP to up to about 11000K.

Compared to the prior art full-color PDP 10, the plurality of barrier ribs 56 of the present invention are arranged in equidistant cooperation with traverse ribs of various sizes and placements, which is used to adjust the coverage of the various phosphor layers. This is used to boost the color temperature of the present invention PDP to up to about 11000K.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A plasma display panel comprising:

a back substrate;

a front substrate positioned on the back substrate and forming a space between the facing surfaces of the front substrate and the back substrate;

a plurality of barrier ribs positioned in the space for defining a plurality of discharge space groups, each group comprising a first discharge space, a second discharge space and a third discharge space;

a first traverse rib positioned in each first discharge space;

a second traverse rib positioned in each second discharge space, the transverse length of the second traverse rib being smaller than that of the first traverse rib;

a blue-emissive phosphor layer coated on the surfaces of the back substrate, the first traverse ribs, and on the barrier ribs surrounding each first discharge space;

a green-emissive phosphor layer coated on the surfaces of the back substrate, the second traverse ribs, and on the barrier ribs surrounding each second discharge space; and a red-emissive phosphor layer coated on the surfaces of the back substrate, and on the barrier ribs surrounding each third discharge space;

wherein the coverage of the red-emissive phosphor layer is less than that of the green-emissive phosphor layer and the coverage of the blue-emissive phosphor layer is greater than that of the green-emissive phosphor layer.

2. A plasma display panel comprising:

a back substrate;

a front substrate positioned on the back substrate and forming a space between the facing surfaces of the front substrate and the back substrate;

a plurality of barrier ribs positioned in the space for defining a plurality of discharge space groups, each group comprising a first discharge space and a second discharge space;

a first traverse rib positioned in each first discharge space;

a second traverse rib positioned in each second discharge space, the longitudinal length of the second traverse rib being smaller than that of the first traverse rib;

a first phosphor layer coated on the surfaces of the back substrate, the first traverse rib, and on the barrier ribs surrounding each first discharge space; and a second phosphor layer coated on the surfaces of the back substrate, the second traverse rib, and on the barrier ribs surrounding each second discharge space;

wherein for a first discharge space and a second discharge space, a distance between the side of the first traverse rib and the center of the first discharge space is less than a distance between the side of the second traverse rib and the center of the second discharge space, and thus the luminous intensity of the first phosphor layer is greater than that of the second phosphor layer.

3. The plasma display panel of claim 2 wherein the plasma display panel further comprises:

a third discharge space; and a third phosphor layer coated on the surfaces of the back substrate and on the barrier ribs surrounding each third discharge space;

wherein the coverage of the third phosphor layer is less than that of the second phosphor layer.

4. The plasma display panel of claim 3 wherein the plasma display panel further comprises a third traverse rib positioned in each third discharge space, and the longitudinal length of the third traverse rib is less than that of the second traverse rib.

5. The plasma display panel of claim 3 wherein the first phosphor layer is a blue-emissive phosphor layer, the second phosphor layer is a green-emissive phosphor layer, and the third phosphor layer is a red-emissive phosphor layer.

* * * * *